US005463693A

United States Patent [19]

Birli et al.

[11] Patent Number: 5,463,693

[45] Date of Patent: Oct. 31, 1995

[54] VOICE AMPLIFICATION ADAPTER ASSEMBLY FOR FACE MASK

[75] Inventors: Joseph A. Birli, South Euclid; Jack J. Becker, Solon, both of Ohio

[73] Assignee: Audiopack Sound Systems Inc., Cleveland, Ohio

[21] Appl. No.: 150,380

[22] Filed: Nov. 10, 1993

[51] Int. Cl.[6] ..... H04R 1/08

[52] U.S. Cl. ..... 381/75; 381/169

[58] Field of Search ..... 381/75, 168–169; 379/175; 367/132

[56] References Cited

U.S. PATENT DOCUMENTS

| | | | |
|---|---|---|---|
| 1,139,177 | 5/1915 | Ganzer | 379/430 |
| 1,242,672 | 10/1917 | Finley | 379/430 |
| 1,344,349 | 6/1920 | Mickelson | 379/430 |
| 1,656,914 | 1/1928 | Hart | 379/430 |
| 1,666,216 | 4/1928 | Mowat | 411/418 |
| 2,123,196 | 7/1938 | Millard | 128/141 |
| 2,165,856 | 7/1939 | Howey | 178/5.8 |
| 2,847,506 | 8/1958 | Gray et al. | 179/1 |
| 2,942,072 | 6/1960 | Cunningham | 379/430 |
| 2,950,360 | 8/1960 | Duncan | 179/146 |
| 2,953,129 | 9/1960 | Bloom et al. | 128/146 |
| 3,180,333 | 4/1965 | Lewis | 128/141 |
| 3,181,531 | 5/1965 | Angioletti | 128/141 |
| 3,243,511 | 3/1966 | Erdman et al. | 179/1 |
| 3,310,736 | 3/1967 | Bayly et al. | 324/62 |
| 3,314,424 | 4/1967 | Berman | 128/142.4 |
| 3,659,056 | 4/1972 | Morrison et al. | 179/82 |
| 3,736,379 | 5/1973 | Kagan | 179/2 C |
| 3,736,740 | 4/1988 | Parker et al. | 128/201.19 |
| 3,764,748 | 10/1973 | Branch et al. | 179/107 E |
| 3,850,168 | 11/1974 | Ferguson et al. | 128/146.7 |
| 3,881,056 | 4/1975 | Gibson et al. | 179/1 MF |
| 4,010,334 | 3/1977 | Demeter | 179/114 M |
| 4,072,831 | 2/1978 | Joscelyn | 178/188 |
| 4,194,096 | 3/1980 | Ramsey | 179/147 |
| 4,237,341 | 12/1980 | Richards | 179/1 MG |
| 4,258,229 | 3/1981 | Eggert et al. | 179/1 ST |
| 4,374,301 | 2/1983 | Frieder, Jr. | 179/1 R |
| 4,400,591 | 8/1983 | Jennings et al. | 179/156 R |
| 4,471,174 | 9/1984 | Nava | 179/156 R |
| 4,508,936 | 4/1985 | Ingalls | 179/82 |
| 4,683,588 | 7/1987 | Goldberg | 381/61 |
| 4,756,308 | 7/1988 | Ryback | 128/201.19 |
| 4,901,356 | 2/1990 | Bauer | 381/169 |
| 4,957,106 | 9/1990 | Vandeputte | 128/201.19 |
| 4,961,420 | 10/1990 | Cappa et al. | 128/207.12 |
| 4,980,926 | 12/1990 | Noetzel | 381/188 |
| 4,985,922 | 1/1991 | Kolbert | 380/59 |
| 5,060,308 | 10/1991 | Bieback | 359/154 |
| 5,138,666 | 8/1992 | Bauer et al. | 381/169 |

FOREIGN PATENT DOCUMENTS

| | | |
|---|---|---|
| 492664 | 9/1938 | United Kingdom . |
| 0549518 | 11/1942 | United Kingdom . |
| 2165721A | 10/1985 | United Kingdom . |

OTHER PUBLICATIONS

A Respirator–Compatible Communication Device by da Roza, et al. Sep. 20, 1982, pp. 1–38.

*Primary Examiner*—Stephen Brinich
*Attorney, Agent, or Firm*—Calfee Halter & Griswold

[57] ABSTRACT

A voice transmission system for a protective respirator, having a face mask with an inhalation port and a filter attached to the inhalation port, is provided. The voice transmission system comprises a microphone assembly adapted to be located between the inhalation port and the air filter, the microphone assembly including a spacer for separating the filter from the inhalation port and a microphone extending therefrom and into an interior space of the face mask, and a combined amplifier/loudspeaker assembly remotely connected to the microphone. The spacer of the microphone assembly provides an airtight seal between the filter and the face mask and includes a one-way inhalation valve. The spacer is provided with an outer surface configuration which matches the face mask on one side and the filter on another so that the microphone assembly may be attached intermediate the face mask and the filter without using any additional fasteners.

20 Claims, 4 Drawing Sheets

VOICE AMPLIFICATION ADAPTER ASSEMBLY FOR FACE MASK

FIELD OF THE INVENTION

The present invention relates generally to voice transmission systems for protective masks and more particularly to a voice transmission adaptor assembly which may be easily installed into a protective mask otherwise not equipped for voice amplification.

BACKGROUND OF THE INVENTION

Protective face masks or respirators for the human face are well known. Persons wearing such respirators often have a need to communicate with one another, particularly in emergency situations. Respirators not equipped with voice amplification mechanisms are typically provided with a valve through which the wearer both exhales and speaks. Sound transmitted through such valves, however, is somewhat muffled, and thus various communications systems have been developed for respirators to improve sound transmission capabilities.

For example, U.S. Pat. No. 4,901,356 to Bauer employs separate microphone and amplifier assemblies to provide a voice transmission system which may be used with a protective respirator. U.S. Pat. No. 5,138,666 to Bauer et al. provides a system for a similar purpose which utilizes a combined microphone and amplifier assembly. In each of these systems, the microphone and the amplifier are located outside of the protective mask.

Locating the microphone outside of the mask, however, is disadvantageous in that the microphone must pick up the wearer's voice after it has passed through the valve in its muffled state. In addition, the volume level of the voice prior to amplification is diminished, and must be raised by increasing the gain of the amplifier, which increases power consumption. Further, by placing both the microphone and the amplifier outside the mask, acoustic isolation of these items is difficult and thus acoustic feedback problems are encountered.

By placing the microphone inside the mask and acoustically isolating it from the amplifier electronics, sound quality is improved, less feedback problems are experienced, and, because a decreased amplifier gain is required, power consumption is reduced. Because most respirator voice amplification devices are battery operated, power consumption is an important consideration.

Its known to have microphones contained within the mask and amplifier electronics located outside the mask. For example, UK Patent Application GB 2 165 721A discloses an internal microphone and external amplifier electronics. However, in such an embodiment, the microphone must be separately attached to the inside of the mask. Moreover, even with the microphone separated from the amplifier assembly by a couple inches, because the amplifier is attached to the mask and therefore remains in relatively close proximity to the amplifier/speaker, acoustic feedback problems are likely to persist.

Accordingly, it is an object of the present invention to provide a voice transmission assembly which may be easily incorporated into an existing respirator and which provides clear sound and low power consumption, having an internal microphone which need not be separately mounted in the mask. It is a further object to provide such an adaptive system which permits the amplifier/speaker assembly to be remotely mounted away from the mask and the microphone contained therein to eliminate acoustic feedback problems.

SUMMARY OF THE INVENTION

A voice transmission system for a protective respirator is provided. The respirator includes a face mask with an inhalation port and a filter attached to the inhalation port. The voice transmission system comprises microphone assembly adapted to be located on the mask between the inhalation port and the air filter, and a combined amplifier/loudspeaker assembly connected to the microphone assembly. The microphone assembly includes a spacer for separating the filter from the inhalation port, through which a microphone extends into an interior space of the face mask. The combined amplifier/loudspeaker assembly is remotely located from the microphone assembly, for example on the wearer's belt or shoulder, to minimize acoustic feedback problems.

A gasket and valve are provided to insure an airtight seal between the mask and the filter at the location of the inhalation port. The spacer element is provided with an outer surface configuration which matches the face mask on one side and the filter on another so that the microphone assembly may be attached intermediate the face mask and the filter without using any additional fasteners.

The spacer element may be attached to either side of the mask intermediate the mask and the filter. The spacer element of the voice transmission assembly is readily installed between the mask and one of the filters by (i) removing the filter, (ii) installing the spacer element onto the mask at the location of the inhalation port where the filter had been attached, and (iii) installing the filter onto the spacer element.

DETAILED DESCRIPTION OF THE PREFERRED EMBODIMENT

Figure 1:
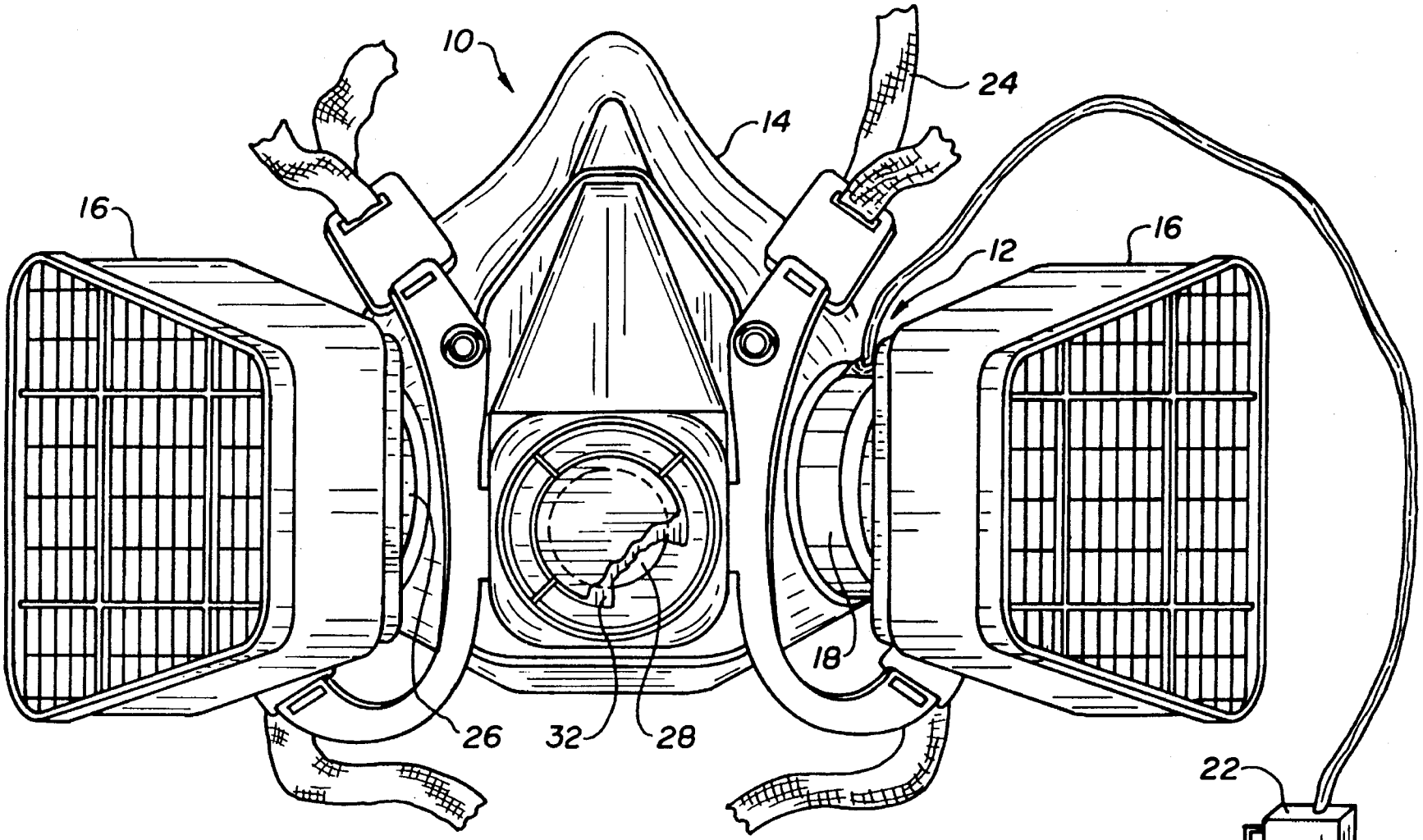
FIG. 1 is a perspective view of a standard respirator into which is incorporated a voice transmission assembly constructed according to the principles of the present invention.

FIG. 1 shows a standard respirator 10 into which is incorporated a voice transmission assembly 12 constructed according to the principles of the present invention. The standard respirator 10 comprises a mask 14 and a pair of side filter assemblies 16. Although two side filter assemblies 16 are shown in FIG. 1, the invention contemplates the use of the voice transmission assembly 12 in respirators having other filter configurations. The voice transmission assembly 12 is attached to the respirator 10 intermediate the mask 14 and one of the filter assemblies 16. The voice transmission assembly 12 comprises a spacer element 18 through which a microphone 20 (see FIG. 2) is passed through to the interior of the mask, and a combination amplifier/loudspeaker assembly 22 located remote from the mask.

Figure 2:
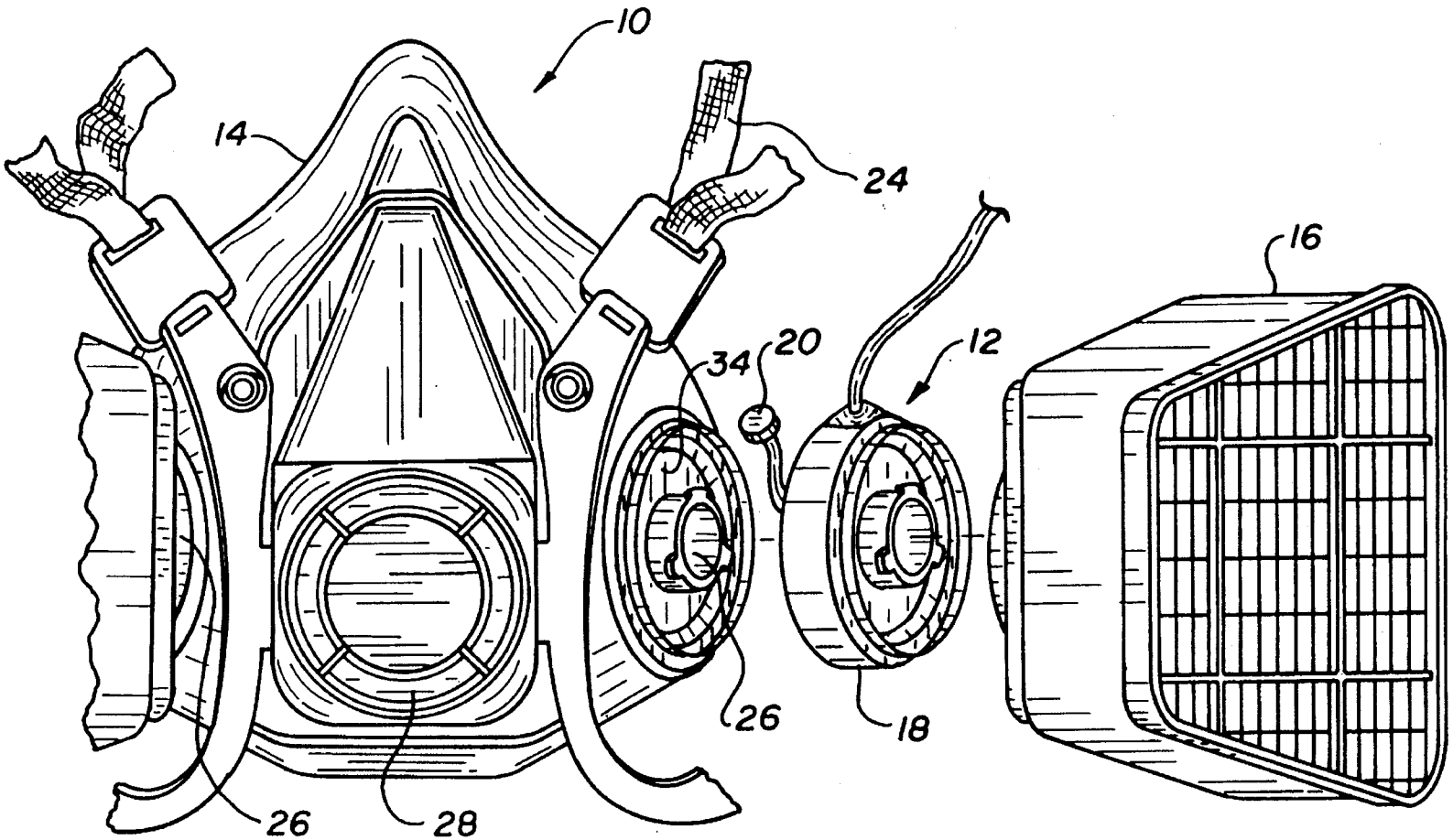
FIG. 2 is an partial exploded perspective view of the respirator of FIG. 1.

The manner in which the voice transmission assembly 12 is incorporated into the respirator 10 is better illustrated in the exploded view of FIG. 2. The respirator 10 is one which is commercially available, such as one of the 6000 Series by 3M Occupational Health and Environmental Safety Division, St. Paul, Minn. Although the respirator shown in FIGS. 1 and 2 is a half-face respirator which provides no protection for the eyes of the wearer, the invention may be incorporated into full-face respirator just as readily as explained below.

The respirator mask 14 is provided with straps 24 which encircle the back of the head of the wearer to hold the mask snugly against the wearer's face. The wearer breathes outside air which is filtered by the filter assemblies 16 through inhalation ports 26, and exhales through an exhalation port 28. The inhalation port is provided with an inhale diaphragm 30 and the exhalation port is provided with an exhale diaphragm 32. The diaphragms are made of a flexible material such as an elastomer or a flexible plastic. The inhale diaphragm 30 surrounds the inhalation port 26 and is pulled inward when the wearer breathes in (See FIG. 3). The exhale diaphragm 32 surrounds the exhalation port 28 and is pushed outward when the wearer exhales (See FIG. 2).

Figure 3:
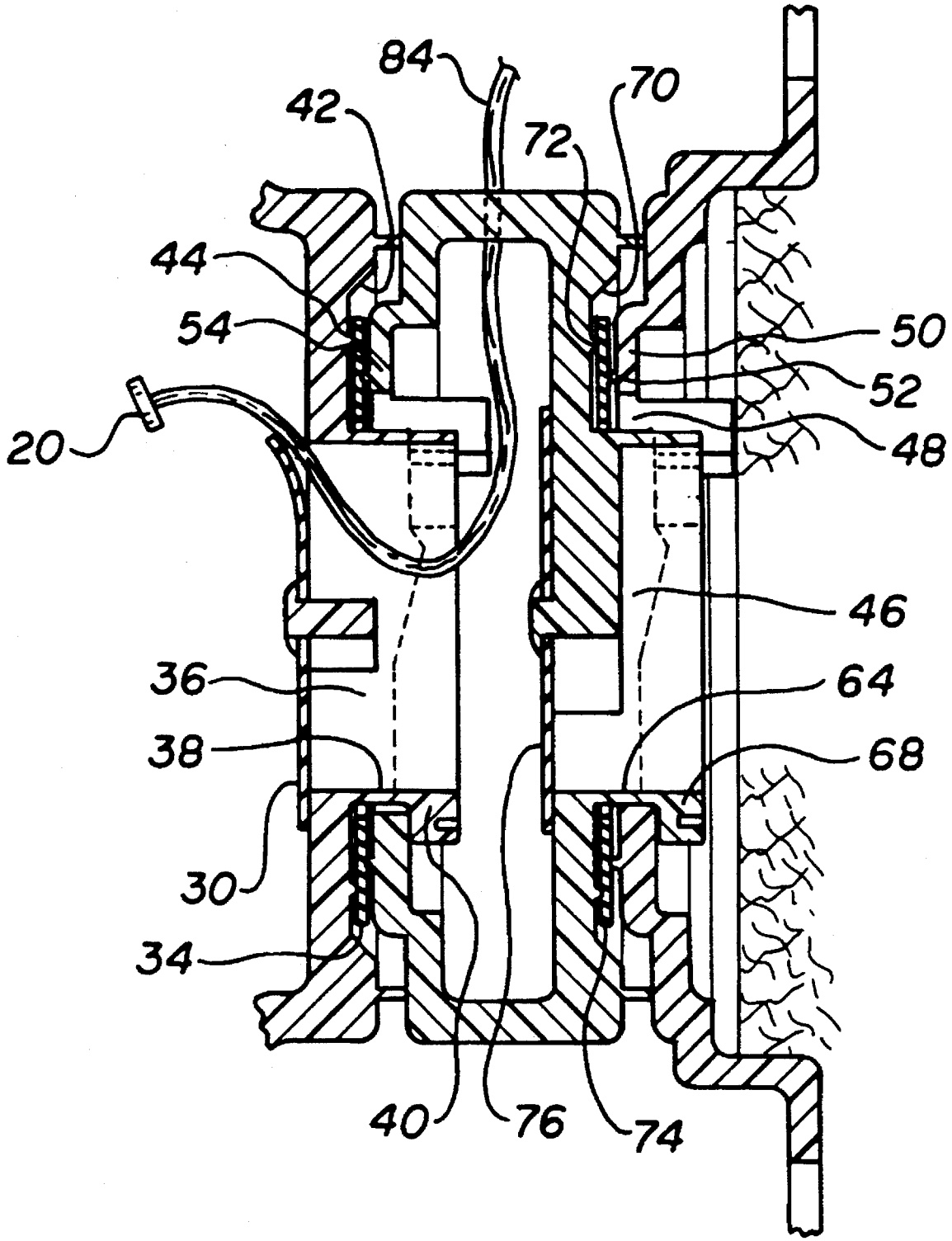
FIG. 3 is a cross sectional view of the voice transmission assembly of FIG. 1.

As shown in FIG. 3, the voice transmission assembly 12 may be attached to either side of the mask 14 intermediate the mask and the filter 16. Typically, the filter 16 is easily removable from the mask 14 to facilitate replacement of filters. A gasket 34 is provided to insure an airtight seal between the mask and the filter at the location of the inhalation port 26. The inhalation port 26 is provided with an opening 36 surrounded by a shoulder 38, from which extend overhanging tabs 40. A recessed portion 42 having a circular ridge 44 thereon surrounds the shoulder 38. The rubber gasket 34 fits over the recessed portion 42 and surrounds the opening 36.

The filter 16 is provided with a corresponding opening 46 having on its perimeter notches 48 corresponding to the tabs 40 on the mask 14. Surrounding the opening 46 is a boss 50 having a circular ridge 52 thereon. The filter 16 is attached to the mask by fitting tabs 40 into the notches 48 and rotating the filter clockwise to lock the filter into place. The tabs (and corresponding notches) may be irregularly spaced so as to insure exact positioning of the filter with respect to the mask. An airtight seal is provided by the gasket 34 which mates with the recessed portion 42 and circular ridge 44 of the mask on one side, and the boss 50 and circular ridge 52 of the filter on the other.

The spacer element 18 of the voice transmission assembly 12 is readily installed between the mask and one of the filters 16 by (i) removing the filter, (ii) installing the spacer element 18 onto the mask at the location of the inhalation port 26 where the filter had been attached, and (iii) installing the filter 16 onto the spacer element. The spacer element 18 is better illustrated in FIGS. 4 and 5. One side of the spacer element (FIG. 4) is adapted to face the mask and is provided with a geometric surface configuration identical to that of the filter 16. A boss 54 is adapted to mate with the gasket 34 on the mask, and is provided with a circular ridge 56 to insure an airtight seal. An opening 58 and notches 60 facilitate installation of the spacer element 18 on the mask in the same manner as the filter is installed thereon. The boss 54, the circular ridge 56, the opening 58 and the notches 60 on the spacer element 18 have the identical geometric configuration as the boss 50, the circular ridge 52, the opening 46 and the notches 48 on the filter element.

Figure 5:
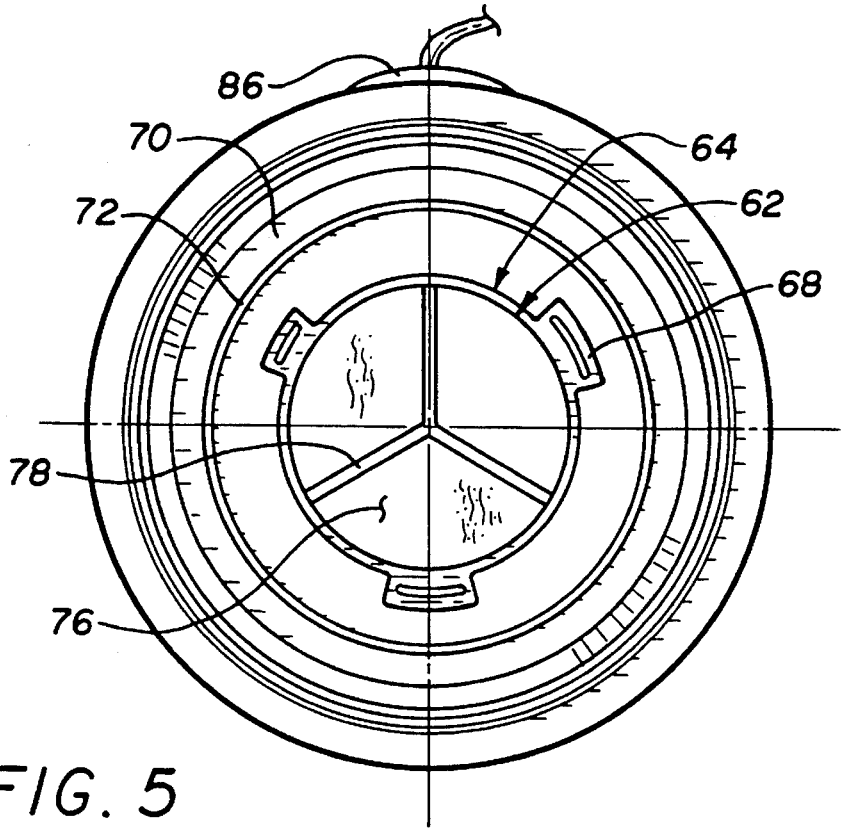
FIG. 5 is an end view of the voice transmission assembly of FIG. 1, showing a side of the assembly which faces the filter of the standard respirator.

FIG. 5 shows the side of the spacer element 18 which is adapted to face the filter 16. This side of the spacer element is provided with a geometric surface configuration identical to that of the inhalation port 26 of the face mask 14. Similar to the inhalation port 26, the spacer element is provided with an opening 62 surrounded by a shoulder 64, from which extend overhanging tabs 68. A recessed portion 70 having a circular ridge 72 thereon surrounds the shoulder 64. A rubber gasket 74 fits over the recessed portion 70 and surrounds the opening 62. The boss 50 and circular ridge 52 on the filter are adapted to mate with the gasket 74 on the spacer element when installed thereon to provide an airtight seal between the spacer element and the filter. The shoulder 64 and tabs 68 on the spacer element facilitate installation of the filter 16 onto the spacer element 18 in the same manner as the filter is installed on the mask. The opening 62, the shoulder 64, the tabs 68, the recessed portion 70, and the circular ridge 72 on the spacer element correspond geometrically to the opening 36, the shoulder 38, the tabs 40, the recessed portion 42, and the circular ridge 44 on the inhalation port 26 of the mask.

As shown in FIG. 3, the spacer element 18 is also provided with an additional inhale diaphragm 76. The inhale diaphragm 76 is supported in place by support members 78 (see FIG. 5) extending inwardly from the shoulder 64 of the spacer element 18. A post 80 (see FIG. 4) located at the intersection of the support members 76 holds the diaphragm 74 in place.

Figure 4:
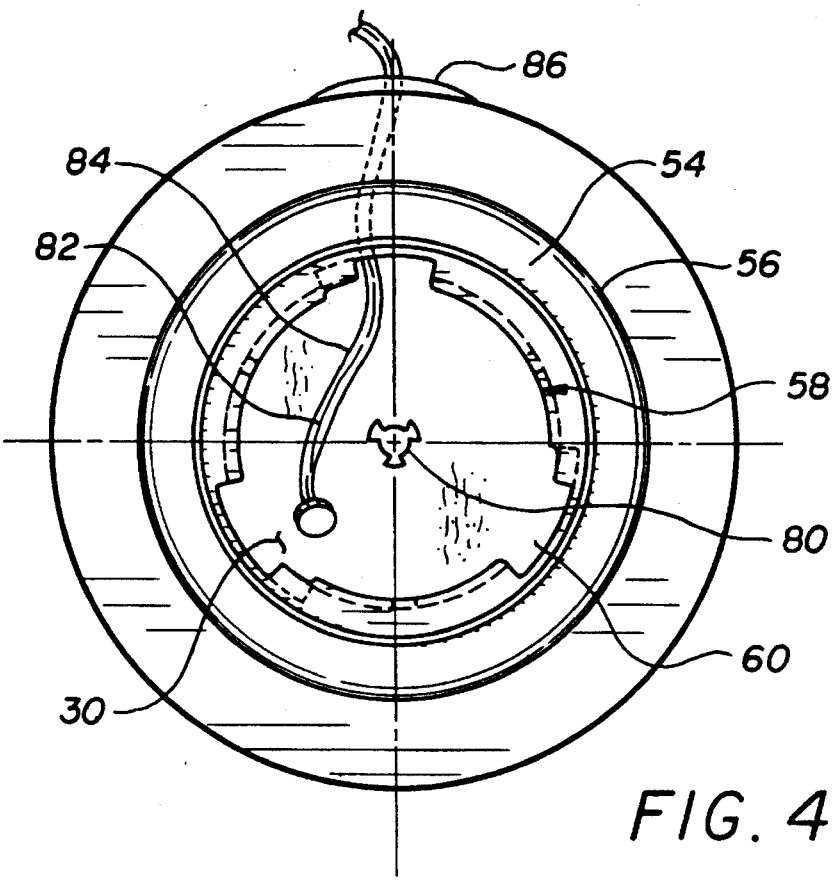
FIG. 4 is an end view of the voice transmission assembly of FIG. 1, showing a side of the assembly which faces the mask of the standard respirator.

The spacer element, which generally takes the form of a disk, is preferably formed in two pieces, one having an outer surface as shown in FIG. 4, the other having an outer surface as shown in FIG. 5. The two pieces may be formed from a thermoplastic material by known methods, for example, injection molding. The opposite surfaces of the two pieces may be joined by an appropriate adhesive or by a sonic welding process.

The microphone 20 is of a type commercially available, such as Model No. EM 123 form Primo Microphones, Inc., McKinney, Tex. Microphone wire leads 82, surrounded by a sheath 84, pass through the junction of the two spacer element pieces. Strain relief 86 is provided at the wire lead/spacer element interface. In the completed assembly of the respirator 10 having the spacer element 18 installed therein, the microphone leads are fed past the diaphragm 30 in the inhalation port 26 of the mask, thereby necessitating the additional inhale diaphragm 76 in the spacer element 18.

The wire leads 82 are connected to the combination amplifier/loudspeaker assembly 22 located remote from the mask. The amplifier/loudspeaker assembly 22 may alternatively take the form of a separate amplifier and a separate loudspeaker. These elements, either separate or, combined, are known in the art and may take the form, for example of those shown and described in U.S. Pat. No. 5,138,666 or UK Patent Application GB 2 165 721A. In the preferred embodiment the combination amplifier/loudspeaker assembly 22 is provided with a clip 88 for attaching the amplifier/loudspeaker assembly to a portion of the wearer's clothing. For example the amplifier/loudspeaker assembly may be belt or shoulder mounted. The remote location of the amplifier/loudspeaker assembly with respect to the microphone 20 minimizes acoustic feedback problems.

Accordingly, the preferred embodiment of a voice transmission system for a protective respirator has been described. With the foregoing description in mind, however, it is understood that this description is made only by way of example, that the invention is not limited to the particular embodiments described herein, and that various rearrangements, modifications and substitutions may be implemented without departing from the true spirit of the invention as hereinafter claimed.

What is claimed is:

1. A protective respirator, comprising:

a face mask having an inhalation port through which a wearer of the mask inhales ambient air;

an air filter for filtering the inhaled ambient air and providing filtered air to said inhalation port;

a microphone assembly which is removably detachable from a location between said inhalation port and said air filter, said microphone assembly including a spacer for separating said filter from said inhalation port, said spacer having a body with a passage extending the entire length thereof through which filtered air may pass from said filter to said inhalation port, said spacer further having a microphone extending therefrom;

an amplifier connected to said microphone for receiving and amplifying sound transmitted by said microphone and outputting an amplified signal; and a loudspeaker connected to said amplifier for receiving and radiating said amplified signal.

2. The protective respirator of claim 1, wherein said amplifier and said loudspeaker form a combined amplifier/loudspeaker assembly.

3. The protective respirator of claim 2, wherein said combined amplifier/loudspeaker assembly is located remote from said face mask.

4. The protective respirator of claim 3, wherein said combined amplifier/loudspeaker assembly is provided with a clip for attaching said amplifier/loudspeaker assembly to a portion of the wearer's clothing.

5. The protective respirator of claim 3, wherein said spacer of said microphone assembly provides an airtight seal between said filter and said face mask.

6. The protective respirator of claim 1, wherein said spacer is provided with an inhale diaphragm, and opposite outer surfaces which lockingly engage, respectively, with said inhalation port and said air filter.

7. The protective respirator of claim 6, wherein said spacer is constructed of a thermoplastic material.

8. The protective respirator of claim 7, wherein said spacer is comprised of two half members sonically welded together.

9. The protective respirator of claim 2, further comprising a wire for connecting said microphone to said combined amplifier/loudspeaker assembly, and wherein said wire includes strain relief means.

10. A voice transmission system for a protective respirator comprising (i) a face mask having an inhalation port through which a wearer of the mask inhales ambient air; and (ii) an air filter for filtering the inhaled ambient air and providing filtered air to said inhalation port, said voice transmission system comprising:

a microphone assembly which is removably detachable from a location between said inhalation port and said air filter, said microphone assembly including a spacer for separating said filter from said inhalation port, said spacer having a body with a passage extending the entire length thereof through which filtered air may pass from said filter to said inhalation port, said spacer further having a microphone extending therefrom;

an amplifier connected to said microphone for receiving and amplifying sound transmitted by said microphone and outputting an amplified signal; and a loudspeaker connected to said amplifier for receiving and radiating said amplified signal.

11. The voice transmission system of claim 10, wherein said amplifier and said loudspeaker form a combined amplifier/loudspeaker assembly.

12. The voice transmission system of claim 11, wherein said combined amplifier/loudspeaker assembly is located remote from said face mask.

13. The voice transmission system of claim 12, wherein said combined amplifier/loudspeaker assembly is provided with a clip for attaching said amplifier/loudspeaker assembly to a portion of the wearer's clothing 14. The voice transmission system of claim 12, wherein said spacer of said microphone assembly provides an airtight seal between said filter and said face mask.

15. The voice transmission system of claim 14, wherein said spacer is provided with an inhale diaphragm, and opposite outer surfaces which lockingly engage, respectively, with said inhalation port and said air filter.

16. The voice transmission system of claim 15, wherein said spacer is constructed of a thermoplastic material.

17. The voice transmission system of claim 16, wherein said spacer is comprised of two half members sonically welded together.

18. The voice transmission system of claim 10, further comprising a wire for connecting said microphone to said combined amplifier/loudspeaker assembly, and wherein said wire includes strain relief means.

19. A protective respirator, comprising:

a face mask having an inhalation port through which a wearer of the mask inhales ambient air;

an air filter for filtering the inhaled ambient air and providing filtered air to said inhalation port;

a microphone assembly located between said inhalation port and said air filter, said microphone assembly including a spacer for separating said filter from said inhalation port and a microphone extending therefrom and into an interior space of said face mask, said spacer providing an airtight seal between said filter and said face mask, said spacer having (i) a first outer surface facing an outer surface of said face mask, and (ii) a second outer surface facing an outer surface of said filter, and wherein said first outer surface and face mask outer surface, and said second outer surface and said filter outer surface, respectively, are provided with complementary geometrical configurations which mate with each other; and an amplifier/loudspeaker assembly located remote from said microphone and including (i) an amplifier connected to said microphone for receiving and amplifying sound transmitted by said microphone and outputting an amplified signal, and (ii) a loudspeaker connected to said amplifier for receiving and radiating said amplified signal.

20. A voice transmission system for a protective respirator including (i) a face mask having an inhalation port through which a wearer of the mask inhales ambient air; and (ii) an air filter for filtering the inhaled ambient air and providing filtered air to said inhalation port, said voice transmission system comprising:

a microphone assembly adapted to be located between said inhalation port and said air filter, said microphone assembly including a spacer for separating said filter from said inhalation port and a microphone extending therefrom and into an interior space of said face mask, said spacer providing an airtight seal between said filter and said face mask, said spacer having (i) a first outer surface facing an outer surface of the face mask, and (ii) a second outer surface facing an outer surface of the filter, and wherein said first outer surface and face mask outer surface, and said second outer surface and said filter outer surface, respectively, are provided with complementary geometrical configurations which mate with each other; and an amplifier/loudspeaker assembly located remote from said face mask and comprising (i) an amplifier connected to said microphone for receiving and amplifying sound transmitted by said microphone and outputting an amplified signal, and (ii) a loudspeaker connected to said amplifier for receiving and radiating said amplified signal.

* * * * *